US008432318B2

(12) United States Patent
Yang et al.

(10) Patent No.: US 8,432,318 B2
(45) Date of Patent: Apr. 30, 2013

(54) CAPACITIVE ANTENNA STRUCTURE

(75) Inventors: Tsai-Yi Yang, Tainan Hsien (TW); Wei-Hung Hsu, Tainan Hsien (TW)

(73) Assignee: Cirocomm Technology Corp., Tainan Hsien (TW)

( * ) Notice: Subject to any disclaimer, the term of this patent is extended or adjusted under 35 U.S.C. 154(b) by 424 days.

(21) Appl. No.: 12/950,104

(22) Filed: Nov. 19, 2010

(65) Prior Publication Data

US 2012/0127036 A1 May 24, 2012

(51) Int. Cl.
*H01Q 1/38* (2006.01)

(52) U.S. Cl.
USPC ..... 343/700 MS

(58) Field of Classification Search ..... 343/700 MS, 343/702, 749
See application file for complete search history.

(56) References Cited

U.S. PATENT DOCUMENTS 8,035,564 B2 * 10/2011 Yang et al. ..... 343/700 MS

* cited by examiner

*Primary Examiner* — Hoang V Nguyen
(74) *Attorney, Agent, or Firm* — Chun-Ming Shih; HDLS IPR Services

(57) ABSTRACT

A capacitive antenna structure comprises a substrate and a sheet-shaped capacitor. The substrate has a radiating metal layer and a grounding metal layer thereon. The radiating metal layer has a first groove to expose the front surface of the substrate, the first groove having a signal feeding hole therein and having a second groove on the edge. The grounding metal layer has a third groove on the edge to expose the substrate, the third groove being opposite to the second groove, the third groove having a first contact and a second contact on two sides respectively to electrically connect to the capacitor. The third groove may connect to a fourth groove to expose the substrate, the fourth groove having a signal transmission line therein, and the signal transmission line having the signal feeding hole to connect a cable.

10 Claims, 7 Drawing Sheets

CAPACITIVE ANTENNA STRUCTURE

BACKGROUND OF THE INVENTION

1. Field of the Invention

The invention relates to an antenna, and more particularly, to an antenna structure having a sheet-shaped capacitor.

2. Description of Prior Art

Currently, many portable electronic devices will adopt the exposed type antenna structure in order to have a good reception, but the exposed antenna structure not only fails to meet a design of miniaturized form device, but also fails to meet a need of built-in design of antenna.

In order to achieve a miniaturized design of antenna, manufacturers mainly provide a planar antenna pattern on a substrate, and layout the planar antenna pattern by adjusting the ratio of major axis and minor axis, as well as non-uniform line width in accordance with the operation feature of reception and emission of signals to achieve an antenna with nearly omnidirection radiation field. However, it is not easy to adjust the ratio of major axis and minor axis, as well as non-uniform line width of the planar antenna pattern provided on the antenna in the design, and planar antenna pattern will become more complex and difficult to layout, thus there is a problem in the design of miniaturized antennas.

SUMMARY OF THE INVENTION

It is an object of the invention to overcome the problem of traditional antennas. The invention provides a sheet-shaped capacitor on an antenna so as to couple and excite the energy on the antennas, improve reception and emission of the antennas, and let the antenna structure become simpler and easier to manufacture.

The object described above is achieved by a capacitive antenna structure of the invention. The capacitive antenna structure comprises: a substrate having a front surface and a rear surface, the front surface having a radiating metal layer thereon, the radiating metal layer having a first groove to expose the front surface of the substrate, the first groove having a signal feeding hole therein and keeping the signal feeding hole and the radiating metal layer with a distance to form a state of electrically disconnection, the radiating metal layer having a second groove on the edge, and the rear surface having a grounding metal layer, the grounding metal layer has a third groove on the edge to expose the rear surface of the substrate, the third groove being opposite to the second groove of the front surface of the substrate, the third groove having a first contact and a second contact on two sides respectively, the third groove connecting to a fourth groove to expose the substrate, the fourth groove having a signal transmission line therein, and the signal transmission line having the signal feeding hole; and a capacitor electrically connecting to the first and second contacts, and being opposite to the second groove of the front surface of the substrate.

Figure 6:
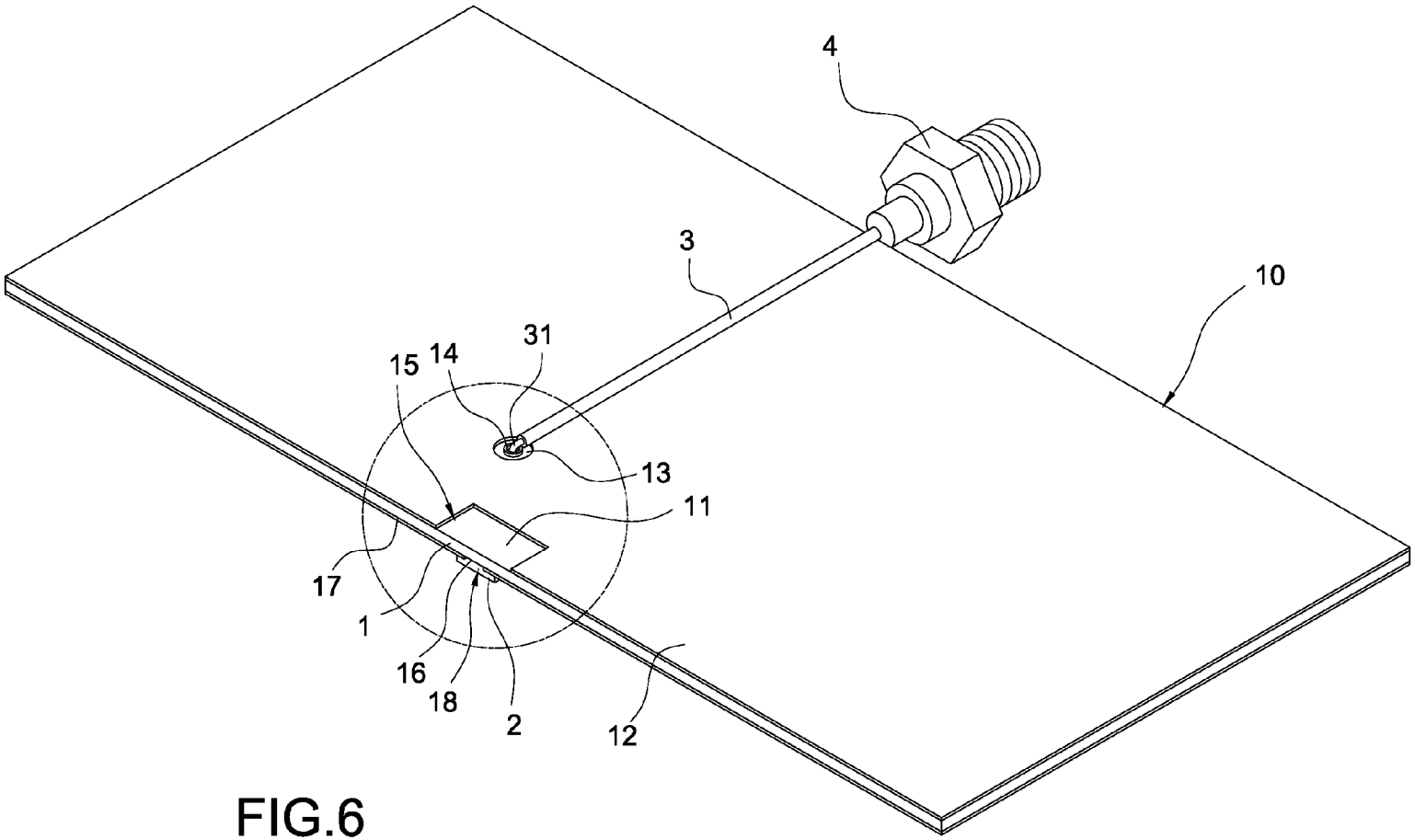

The FIG. 6 is an antenna according to another preferred embodiment of the present invention.

Figure 7:
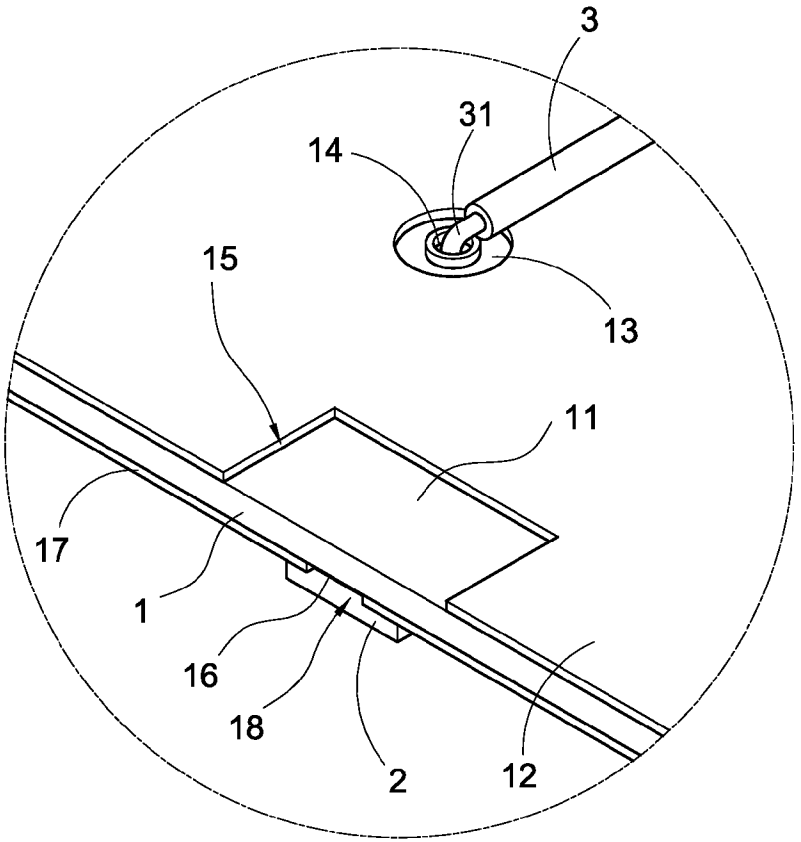

The FIG. 7 is a partly enlarged view of FIG. 6.

DETAILED DESCRIPTION OF THE INVENTION

A preferred embodiment of the present invention will be described with reference to the drawings.

Figure 1:
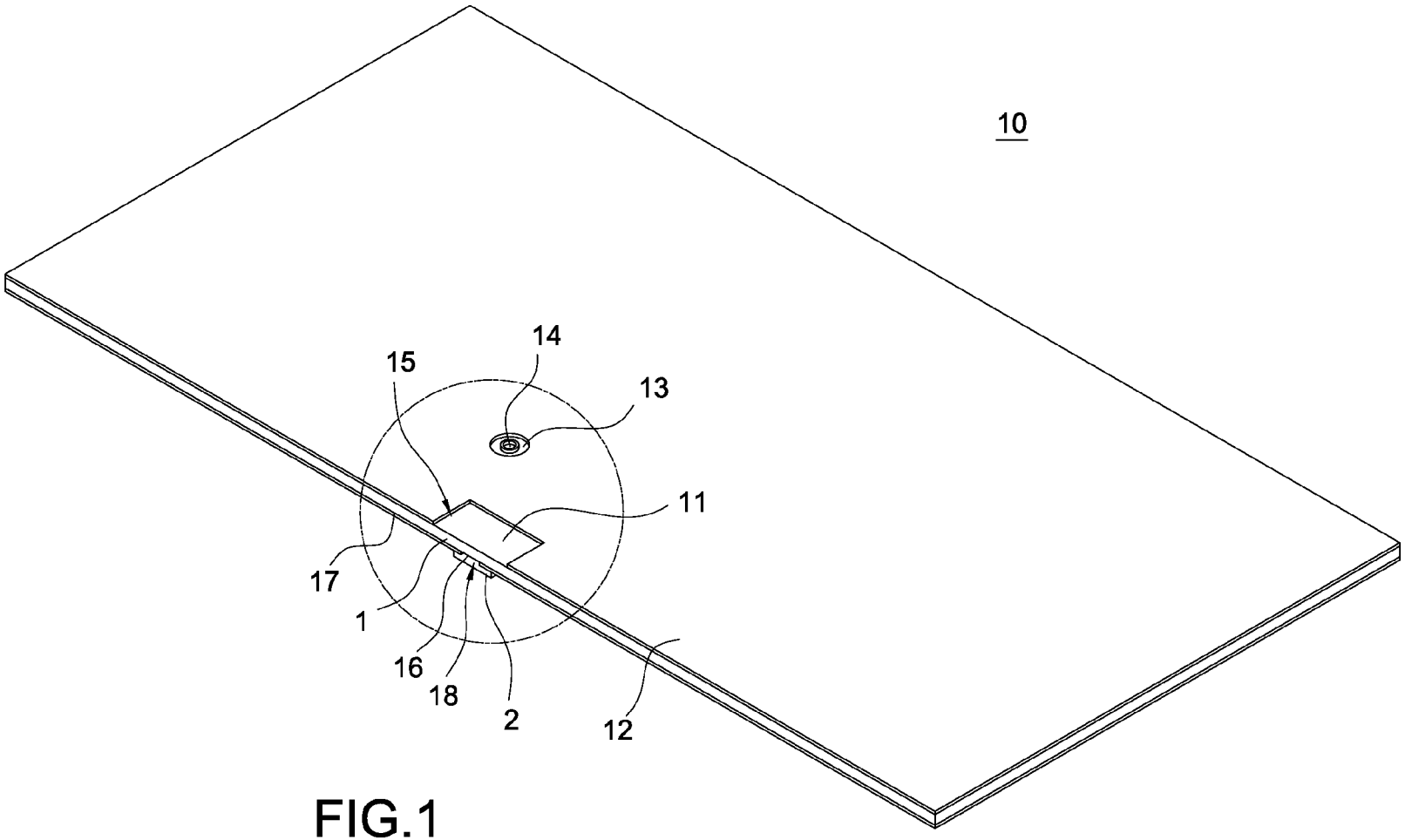
FIG. 1 is a front elevational view of an antenna according to a preferred embodiment of the present invention.
Figure 2:
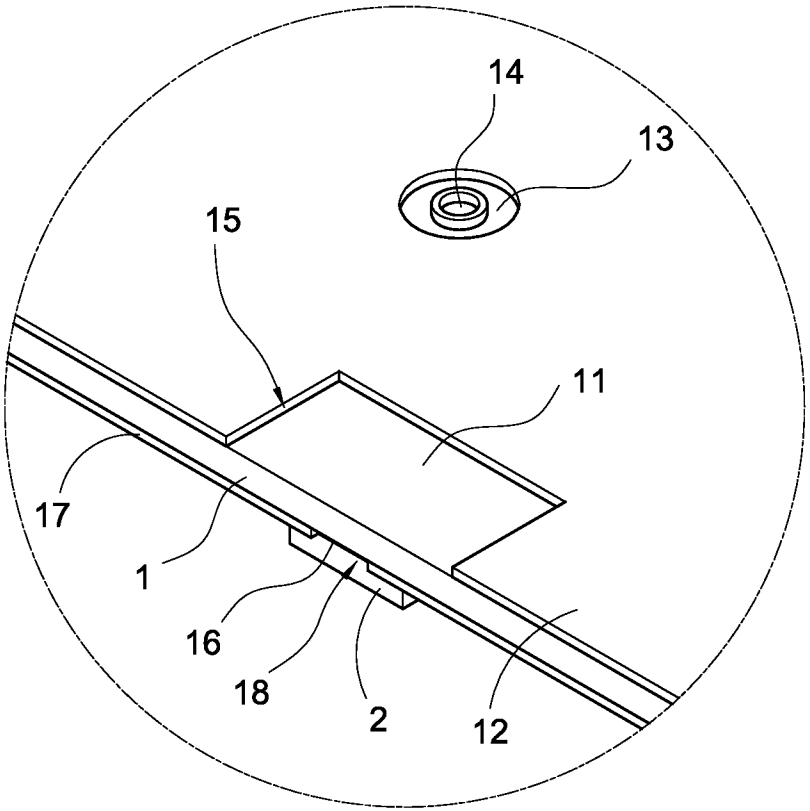
FIG. 2 is a partly enlarged view of FIG. 1.

Please refer to FIGS. 1 and 2. FIG. 1 is a front perspective view of an antenna according to a preferred embodiment of the present invention. FIG. 2 is a partly enlarged view of FIG. 1. A capacitive antenna structure of the present invention comprises an antenna 10 having a substrate 1 made of glass fibers or ceramics. The substrate 1 has a front surface 11. The front surface 11 has a radiating metal layer 12 thereon. The radiating metal layer 12 has a first groove 13 with round shape to expose the front surface 11 of the substrate 1. The first groove 13 has a signal feeding hole 14 therein and renders the signal feeding hole 14 and the radiating metal layer 12 with a separation to form a state of electrically disconnection, and the signal feeding hole 14 may connect to a wire (not shown in the drawings). In addition, the radiating metal layer 12 has a second groove with a square or rectangular shape on the edge.

Figure 3:
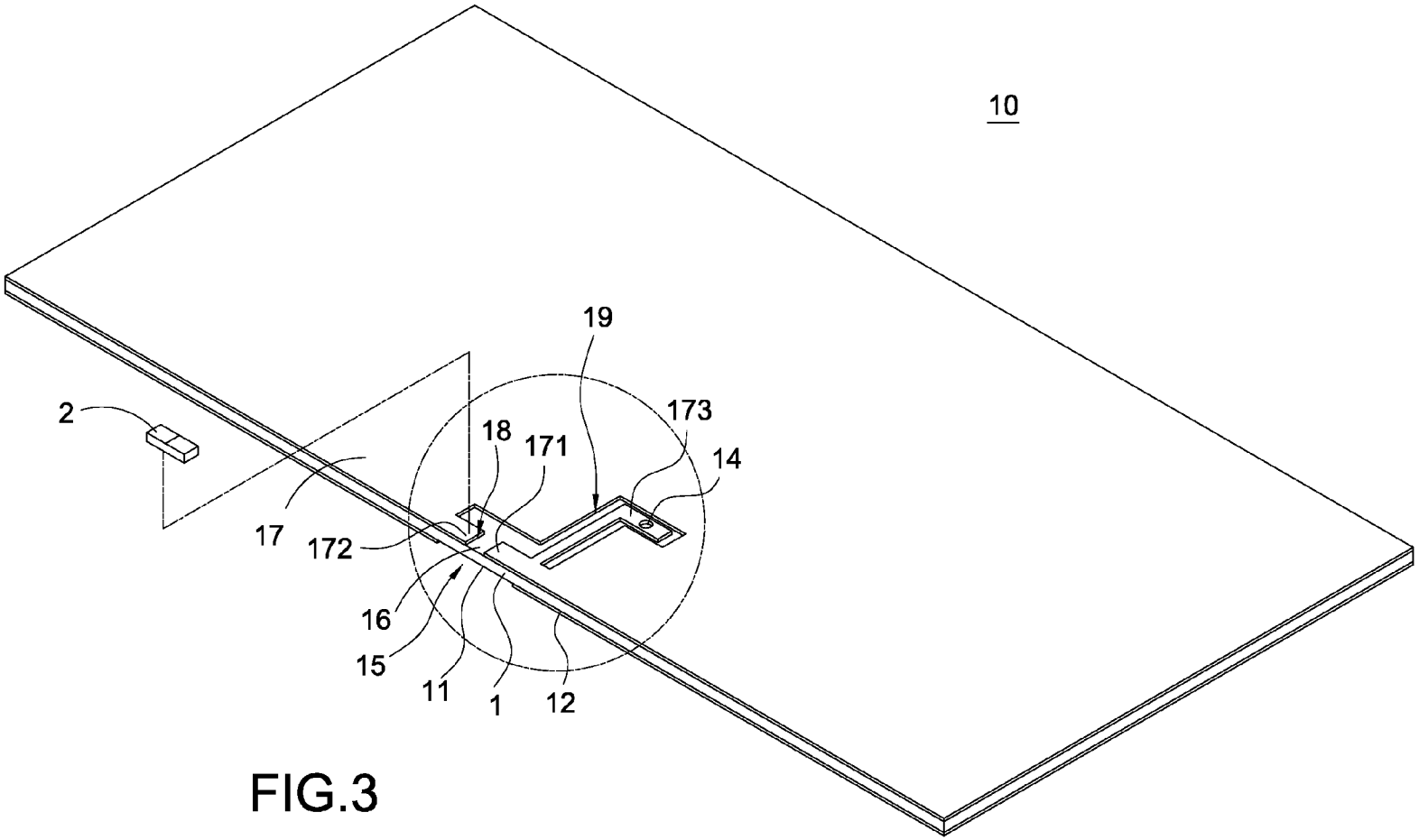
FIG. 3 is a rear elevational view of an antenna according to a preferred embodiment of the present invention.
Figure 4:
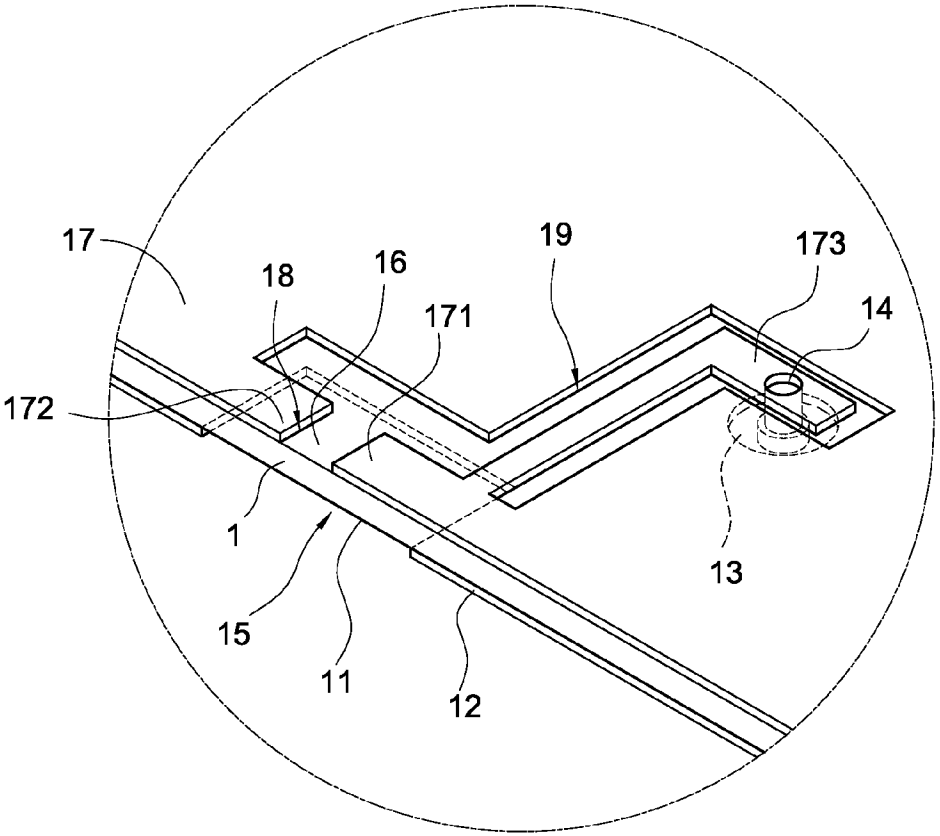
FIG. 4 is a partly enlarged view of FIG. 3.
Figure 5:
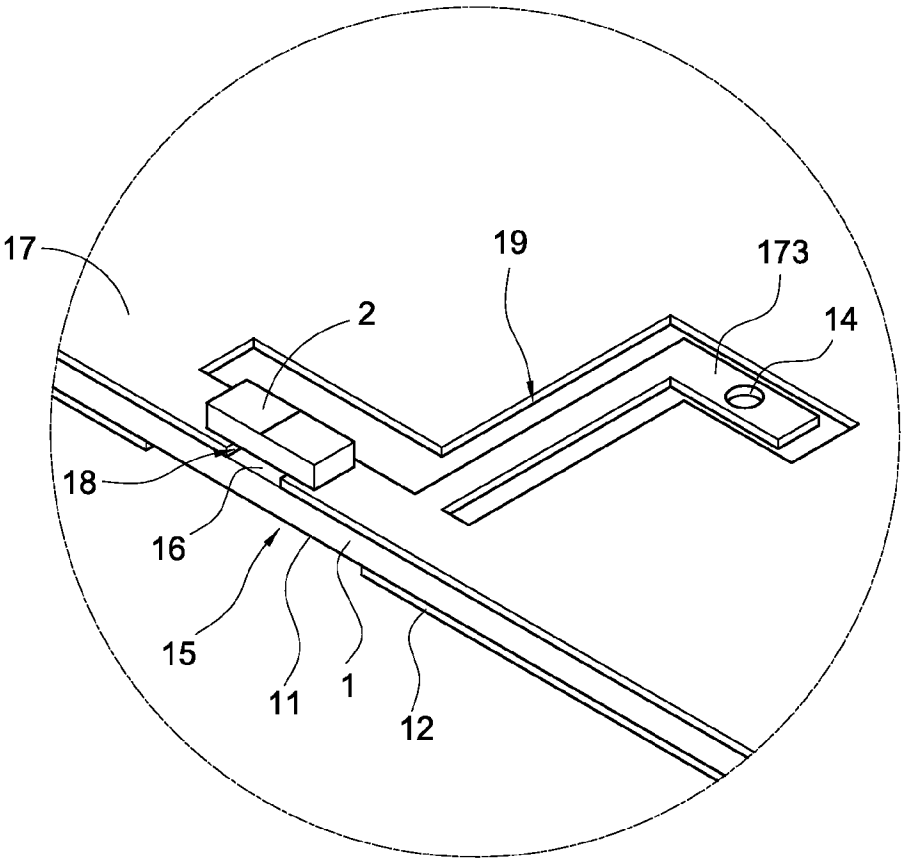
FIG. 5 shows a schematic view of electrically connecting a sheet-shaped capacitor in light of FIG. 4.

Please refer to FIGS. 3, 4 and 5. FIG. 3 is a rear perspective view of an antenna according to a preferred embodiment of the present invention. FIG. 4 is a partly enlarged view of FIG. 3. FIG. 5 shows a schematic view of electrically connecting a sheet-shaped capacitor in light of FIG. 4. As shown in the drawings, the substrate 1 has the rear surface 16 having a grounding metal layer 17. The grounding metal layer 17 has a third groove 18 on the edge to expose the rear surface 12 of the substrate 1, the third groove 18 is opposite to the second groove 15 of the front surface 11 of the substrate 1. The third groove 18 has a first contact 171 and a second contact 172 on two sides respectively. The third groove 18 connects to a fourth groove 19 with an S shape. The fourth groove 19 has an L-shaped signal transmission line 173 therein. The signal transmission line 173 has the signal feeding hole 14 thereon, and the signal feeding hole 14 may connect with a wire (not shown in the drawings) to electrically connect with the signal transmission line 173.

The capacitor 2 is sheet-shaped, which may be adhesive to the first and second contacts 171, 172 with its surface and opposite to the second groove 15 of the front surface of the substrate 1. When electricity flows into the antenna structure, the electricity may flow through the first contact 171 and the capacitor 2 to the second contact 172 so as to couple and excite the energy on the antenna structure, and the electricity flowing through the capacitor 2 may be excited to improve reception and emission of the antennas. Also, the capacitor 2 is opposite to the second groove 15 on the front surface 11 of the substrate 1 so as to mainly prevent the capacitor 2 from being shielded (short) and forming a high-frequency short of the antenna.

The second groove 15 has an area greater than a surface area of the capacitor 2, the surface area being opposite to the second groove 15.2

Please refer to FIGS. 6 and 7. FIG. 6 shows an antenna according to another preferred embodiment of the present invention. The FIG. 7 is a partly enlarged view of FIG. 6. As shown in the drawings, upon using the antenna of the invention, a core 31 inside of a wire 3 is inserted through the signal feeding hole 14 of the substrate 1 to electrically connect to signal transmission line 173 of the rear surface 12 of the substrate 1. The wire 3 has another terminal to electrically connect to a plug 4 of an antenna. The plug 4 of the antenna may be provided to electrically connect to a coaxial cable (not shown in the drawings) for users.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A capacitive antenna structure, comprising:

a substrate having a front surface and a rear surface, the front surface having a radiating metal layer thereon, the radiating metal layer having a first groove to expose the front surface of the substrate, the first groove having a signal feeding hole therein, the radiating metal layer having a second groove on the edge, and the rear surface having a grounding metal layer, the grounding metal layer has a third groove on the edge to expose the rear surface of the substrate, the third groove being opposite to the second groove of the front surface of the substrate, the third groove having a first contact and a second contact on two sides respectively, the third groove connecting to a fourth groove to expose the substrate, the fourth groove having a signal transmission line therein, and the signal transmission line having the signal feeding hole; and a capacitor electrically connecting to the first and second contacts, and being opposite to the second groove of the front surface of the substrate.

2. The antenna structure of claim 1, wherein the substrate is made of glass fibers or ceramics.

3. The antenna structure of claim 1, wherein the first groove is of round shape and renders the signal feeding hole and the radiating metal layer with a separation to form a state of electrically disconnection.

4. The antenna structure of claim 1, wherein the second groove is of square or rectangular shape.

5. The antenna structure of claim 1, wherein the fourth groove is of S-shape.

6. The antenna structure of claim 5, wherein the transmission line is of L-shape.

7. The antenna structure of claim 1, wherein the capacitor is of sheet-shape.

8. The antenna structure of claim 7, wherein the second groove has an area greater than a surface area of the capacitor, the surface area being opposite to the second groove.

9. The antenna structure of claim 1, further including a wire having a core inside, the core being inserted into the signal feeding hole in one terminal to electrically connect to signal transmission line of the rear surface of the substrate.

10. The antenna structure of claim 9, wherein the core of the wire being inserted into the signal feeding hole in one terminal to electrically connect to signal transmission line, and another terminal of the wire electrically connecting to a plug of the antenna.

* * * * *